US005468906A

United States Patent [19]

Colvin, Sr. et al.

[11] Patent Number: 5,468,906

[45] Date of Patent: Nov. 21, 1995

[54] SOUND SYNTHESIS MODEL INCORPORATING SYMPATHETIC VIBRATIONS OF STRINGS

[75] Inventors: Bryan J. Colvin, Sr., San Jose; Perry R. Cook, Palo Alto, both of Calif.

[73] Assignee: Media Vision, Inc., Fremont, Calif.

[21] Appl. No.: 116,165

[22] Filed: Sep. 2, 1993

[51] Int. Cl.[6] ..... G10H 1/08; G10H 5/00

[52] U.S. Cl. ..... 84/625; 84/660; 84/697

[58] Field of Search ..... 84/600–603, 607, 84/608, 622, 623, 625, 626, 630, 647, 660–661, 662, 697

[56] References Cited

U.S. PATENT DOCUMENTS

| | | | |
|---|---|---|---|
| 4,085,648 | 4/1978 | Fricke et al. | 84/1.24 |
| 4,622,877 | 11/1986 | Strong . | |
| 4,649,783 | 3/1987 | Strong et al. . | |
| 4,909,121 | 3/1990 | Usa et al. . | |
| 4,984,276 | 1/1991 | Smith . | |
| 5,136,916 | 8/1992 | Shisukawa | 84/627 |
| 5,212,334 | 5/1993 | Smith, III . | |
| 5,352,849 | 10/1994 | Kobayashi | 84/659 |

OTHER PUBLICATIONS

Smith, Physical Modeling Using Digital Waveguides, Mass. Inst. of Tech. Computer Music Journal, vol. 16, No. 4, 1992.

*Primary Examiner*—Vit W. Miska
*Attorney, Agent, or Firm*—Claude A. S. Hamrick

[57] ABSTRACT

Synthesizer models for emulating musical instruments are improved to take into account sympathetic string vibrations. One embodiment of the present invention scales an output signal from a sound synthesis model and uses the scaled signal as an input signal for a number of single-string emulations causing the single-string emulations to produce sound signals corresponding to sympathetic string vibrations. The output signals from the synthesis model and from all of the single-string emulations are added together. Another embodiment employs an octave's worth of single-string emulations to emulate the lower strings of an emulated instrument. Still another embodiment is a synthesizer which includes an input bus for accepting a sound signal, scaling means, a plurality of single-string emulations, and means for summing output signals from the string emulations. Embodiments preferably employ waveguide synthesis or the plucked string model to emulate single-strings.

17 Claims, 2 Drawing Sheets

SOUND SYNTHESIS MODEL INCORPORATING SYMPATHETIC VIBRATIONS OF STRINGS

BACKGROUND OF THE INVENTION

1. Field of the Invention

This invention relates to sound synthesis and sound synthesis models, and in particular, relates to methods for simulating the sounds made by sympathetic vibrations of strings.

2. Description of Related Art

Most digital sound synthesis methods attempt to mimic a desired sound by generating at regular time intervals digital values that represent the amplitude of the desired sound. One of the most accurate digital methods is sample synthesis. Sample synthesis generates a sound by playing a digitized recording. Sample synthesis is commonly used in drum machines that emulate only a relatively small number of different drum sounds.

In some applications, sample synthesis requires too much memory to be practical. For example, with a piano emulation, a digital recording of the lowest note may last up to 30 seconds and require more than 2 megabytes of 16-bit values representing sound amplitudes if recorded at a 44.1 KHz sample rate. Multiply this by the 88 keys on a standard piano and the required storage capacity exceeds 200 megabytes. Pianos also have different timbres depending on how hard the key is struck. A standard Musical Instrument Digital Interface (MIDI) has 128 different velocity curves so the storage capacity now exceeds 30 gigabytes.

Even if all these sounds were recorded, you would still not have an emulation that sounds exactly like a real piano because the effect of the damper pedal and inter-string coupling would be missing. In a piano, when the damper pedal is not pressed, a felt pad suppresses string vibrations unless the key corresponding to the string is held down. When a combination of keys or chord is held down, the struck strings interact. Similarly, the quality of a note changes when the damper pedal is pressed because all of the strings are coupled together through a sound board. A more accurate sample synthesis would record combinations of piano keys being hit simultaneously with and without the damper pedal being pressed. Taking all possible combinations of 2 out of 88 keys, 3 out of 88 keys, and so on, up to 88 out of 88 keys yields an astronomical number, and still does not take into account time offsets. Sample synthesis therefore cannot practically yield a near perfect piano emulation.

There are many synthesis methods besides sample synthesis. Waveguide synthesis is a synthesis method that mimics the sound of a musical instrument using models based on the physical structure of the instrument. A particular case of waveguide synthesis is the plucked string algorithm which is used to emulate the sound made by a plucked string.

FIG. 1A shows a block diagram of a plucked string algorithm which may be used to emulate the sound made by a string. The plucked string algorithm involves filling a delay line 101 with data. Delay line 101 is generally a digital delay circuit or a section of memory. The output sound amplitudes on output bus 120 are the result of cyclic reading of data from the delay line 101 at a fixed sampling rate.

Data from delay line 101 is processed by a filter 103 to account for sound evolution before being fed back to delay line 101. Filter 103 and the length of delay line 101 are chosen based on the physical properties of the string being emulated. FIGS. 1B and 1C show examples of types of filters that may be used in the plucked string algorithm of FIG. 1A. FIG. 1B shows a zero pole filter having a pair of coefficient multipliers 131 and 132, a delay line 133, and an adder 134. FIG. 1C shows a one pole filter having a pair of coefficient multipliers 141 and 143, a delay line 144, and an adder 143.

Referring again to FIG. 1A, a summing means 102 combines signals from filter 103 with excitation data on input bus 110 and feeds the sum back into delay line 101. When all of the date in delay line 101 has been read once, reading begins again from the beginning in a loop fashion. The sound signal on output bus 120 repeats with a frequency that depends on the number of data points in delay line 101 and the sampling rate.

Generally, a synthesis model will not perfectly reproduce the sound of a musical instrument and methods for improving the accuracy of synthesis models are needed. In particular, a method for adding a damper pedal effect to a piano emulation, which is generally applicable to any piano emulation using any synthesis method, would greatly improve the accuracy of piano emulations. Such a method, to provide greatest utility, should not require excessive memory or excessive computational power.

SUMMARY OF THE INVENTION

The present invention provides methods and structures for improving sound synthesis models by generating sound signals which emulate the sounds of sympathetic string vibrations.

According to one embodiment of the present invention, an output signal from a sound synthesis model is scaled and used as an output signal for a number of single-string emulators causing the single-string emulators to produce sound signals corresponding to sympathetic string vibrations. The output signals from the synthesis model and from all the single-string emulators are added together to produce a synthesized sound. Methods according to this embodiment are independent of the type of synthesis model used because the methods rely only on the signals generated and not on how the signals were generated.

Typically, the synthesis model emulates a stringed instrument, and the single-string emulators emulate the sounds of the actual strings of the emulated instrument. For example, a piano emulator which simulates notes without the effect of a damper pedal may be improved to account for sympathetic vibrations that occur when a damper pedal is pressed. Twelve single-string emulators can use one emulation for each note in an octave.

Another embodiment is a sound synthesizer which includes an input bus for accepting a sound signal, scaling means, a plurality of single-string emulators, and means for summing output signals from the string emulators.

Waveguide synthesis is preferably used in the single-string emulators of the preceding embodiments.

DETAILED DESCRIPTION OF THE PREFERRED EMBODIMENTS

Embodiments of the present invention provide methods and devices for generating signals which represent the sounds of sympathetic vibrations of strings.

Figure 2:
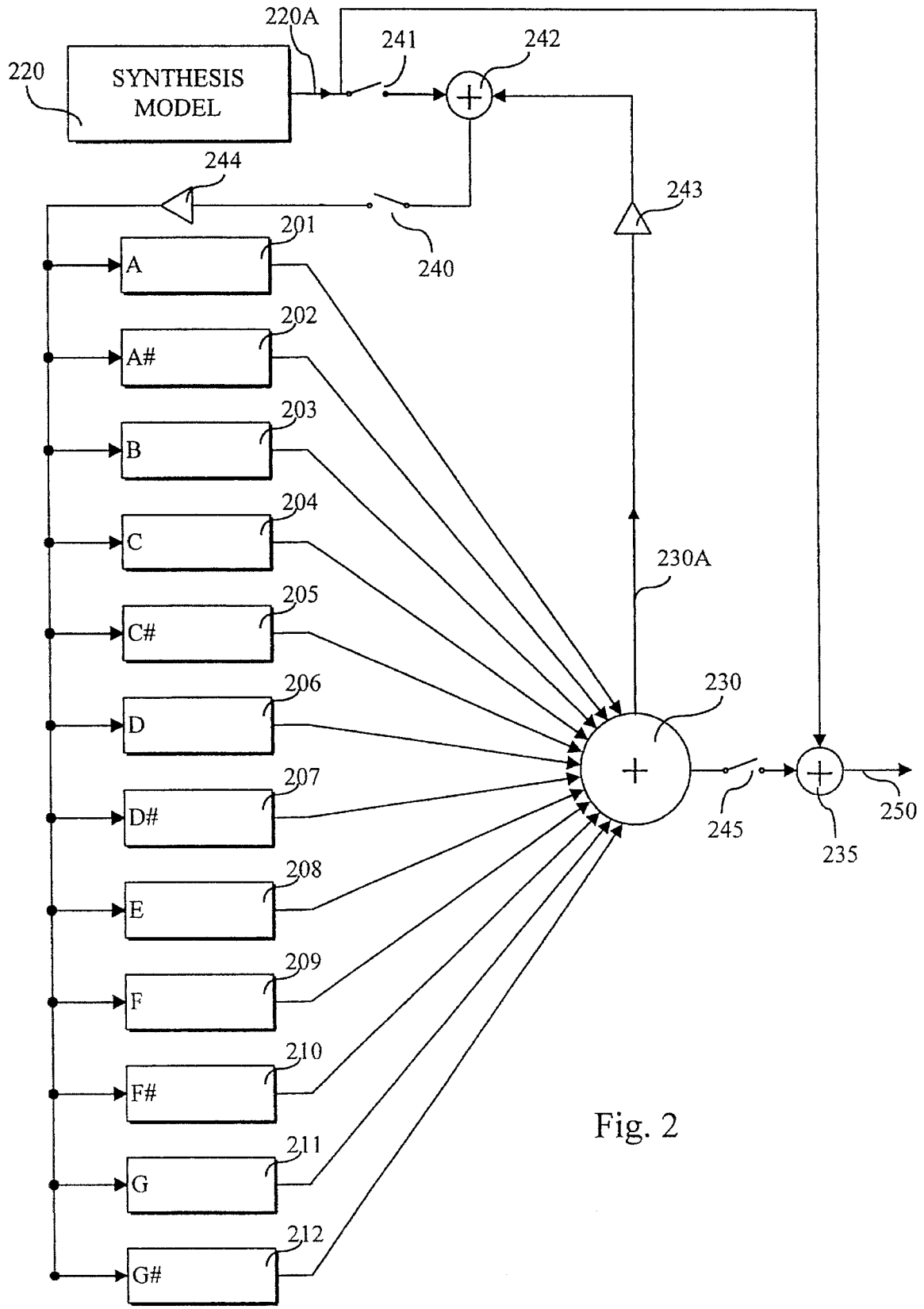
FIG. 2 shows a block diagram of an improved sound synthesis model in accordance with the present invention.

FIG. 2 shows a block diagram piano synthesizer including a damper pedal simulation. Synthesis model 220 emulates the sound of a piano without the damper pedal being pressed, but any generator of digital signals, not just piano emulators, can be used in place of synthesis model 220. The exact nature of synthesis model 220 is not important to the generation of the sound of sympathetic vibrations of strings. Synthesis model 220 can be implemented in hardware or software and generates a signal having a series of digital values representing sound amplitudes. In FIG. 2, buses such as 220A, 230A, and 250 have one or more lines and carry digital signals to and from the elements of the sound synthesizer. In software implementations, the buses indicate data flow between instructions or variables that perform the functions of the elements described.

The sound signal from synthesis model 220 is fed through an adder 242 and a switch 240 to a multiplier 244. Multiplier 244 may be implemented, for example, as a physical circuit element or as a software instruction which multiplies a digital value by a fixed coefficient. Multiplier 244 scales the sound signal by a fixed amount related to the strength of a desired string coupling then feeds the scaled signal into single-string emulators 201–212. Alternatively, other scaling means, including a digital filter and/or individual multipliers for each single-string emulator 201–212, may be employed in place of multiplier 244.

Switch 240 turns on and off the flow of data into single-string emulators 201–212. When switch 240 is open, the output signal from model 220 passes through adder 235 unaltered and the output signal on bus 250 is the signal from synthesis model 220 (a signal representing the sound of a piano without the damper pedal pressed). Switches 241 and 245 are optional, and provide alternative ways of turning on and off the emulation of sympathetic vibration of strings.

When the switch 240 is closed, the scaled sound signal is fed into single-string emulators 201–212. Single-string emulators 201–212 are chosen to respond to an input signal in the same manner that a string would respond to a sound wave. In particular, output signals from single-string emulators 201–212 depend on the magnitude and frequency distribution of the input signal.

Figure 1A:
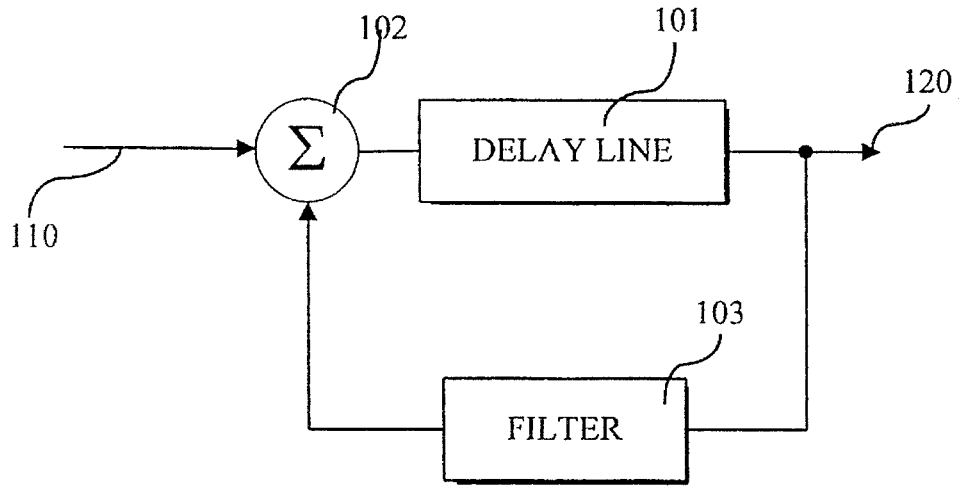
Fig. 1A (Prior Art)
FIG. 1A shows a prior art single-string emulator that uses the plucked string algorithm.
Figure 1B:
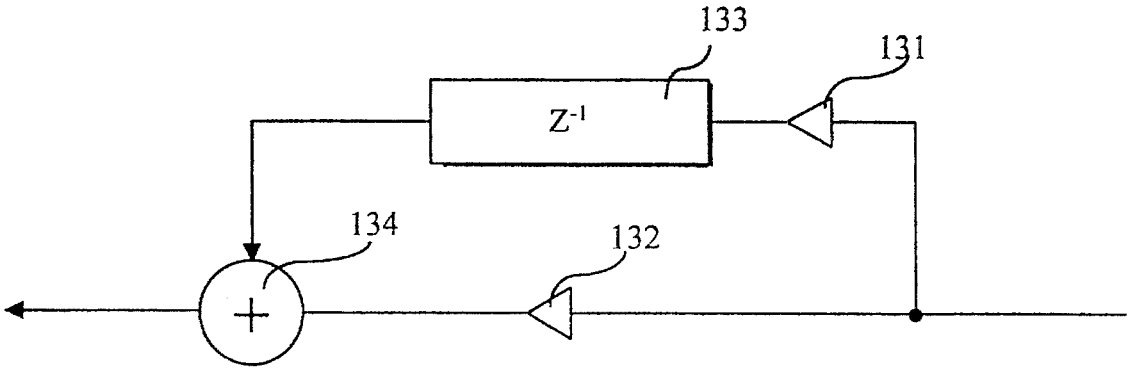
FIG. 1B shows a zero-pole filter that may be used in the plucked string algorithm of FIG. 1A.
Figure 1C:
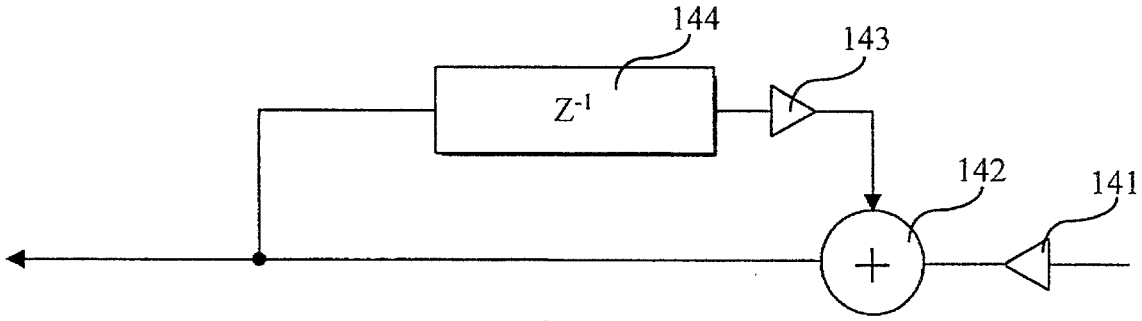
FIG. 1C shows a one-pole filter that may be used in the plucked string algorithm of FIG. 1A.

In one embodiment, the string emulators 201–212 use the plucked string algorithm, such as shown in FIG. 1A. The plucked string algorithm responds with a frequency characteristic of the string emulated and responds in proportion to an input or excitation signal. Other synthesis methods may be used, and single-string emulators 201–212 may be implemented as circuits or in software.

The string emulators 201–212 produce digital signals which represent the sound that a string radiates back after being excited. Signals from the single-string emulator 201–212 are summed by adder 230 then combined with the signal from the synthesis model 220 by adder 235 to produce an output signal on bus 250. The output signal represents the combination of the sound emulated by model 220 and the sound of sympathetic vibration of strings, (the sound of a piano with the damper pedal pressed). Adders 230 and 235 may be implemented in software or in hardware.

The sum of the signals from single string emulators 201–212 is fed from adder 230 through multiplier 243 to adder 242. Adder 242 combines the sum with the signal from model 220. The combination is fed through switch 240 as described above. Combining the signals provides a more accurate excitation for the single-string emulators 201–212 because physical strings in a piano, for example, are driven by sounds from the struck string and sympathetically vibrating strings. Multiplier 243 multiplies the sum from adder 230 by a fixed constant that can adjust the amount of coupling for the instrument emulated. Alternatively, multiplier 243 may be replaced by a digital filter.

In the embodiment of FIG. 2, there are twelve string emulators 201–212. Emulator 201 emulates the note A. The remaining emulators 202–212 emulate the remaining notes in an octave of a chromatic scale as shown. Other numbers of emulators, other beginning notes, and other pitch distributions of strings may be used.

For a standard piano, eighty eight single-string emulators could be used, one for each note on a standard piano. Using a smaller number of single-string emulators reduces the computational power required which decreases the cost of hardware embodiments and increases the speed of software embodiments. Twelve single-string emulators are sufficient to emulate most sympathetic string vibrations in instruments such a pianos or harpsichords which have a large number of strings arranged in octaves on a chromatic scale, particularly when the single-string emulators emulate the lower strings, meaning the deeper or lower pitch notes.

In a chromatic scale, there are twelve notes counting sharps (or flats) in an octave, and sound waves from one octave have sound frequencies which are double that of the preceding octave. A low pitch string resonates with a frequency characteristic of the fundamental mode of the string and with frequencies that are multiples of the fundamental mode. The higher frequency oscillations, therefore, radiate sounds similar to the sound of a string one or more octaves higher. Using twelve or more strings from a lower octave therefore can emulate the effect of most or all strings.

Although typically an octave of the lower strings of a musical instrument is emulated, the octave providing the best emulation will not always be the lowest octave of strings. For piano emulations, string emulators for the next to lowest octave give a very good emulation of the effects of string coupling and a damper pedal.

Using less than twelve string emulators could miss families of notes. For example, leaving out an F string emulator would eliminate some F note responses in higher octaves. Missing a family of notes is not a problem if the missed notes only weakly couple to the struck note. Emulating less than twelve strings may be adequate if the strings emulated are those that couple most strongly with the original signal. For example, if the original signal were a high C, a lower C string would be strongly coupled. Musical thirds, fourths, and fifths have frequencies that are related to the primary note and can also play a significant role.

In one embodiment of the present invention, waveguide synthesis and in particular a plucked string model such as shown in FIG. 1A is used for the string emulators 201–212. The plucked string model is particularly good at emulating the effects of string coupling because an excitation signal on bus 110 can create a sound signal in the same manner that sound drives the sympathetic vibrations of a string. The length of delay line 101 and sampling rate can be tuned to match the frequency of a lower string. The filter 103 and the parameters which control filter 103 can be chosen to match the tension and density of the string. The plucked string model then generates sound signals at the fundamental frequency and higher harmonics of a string.

Although the present invention has been described with reference to particular embodiments, the description is only an example of the invention's application and should not be taken as a limitation. In particular, even though much of preceding discussion was aimed at simulating the effects of a piano damper pedal, the present invention is not limited to a piano or a damper pedal. The embodiment of FIG. 2 can be more generally applied to any signal where the addition of sound from sympathetic string coupling is desired. The scope of the present invention is defined only by the following claims.

We claim:

1. A method for improving a sound synthesis model to account for sympathetic vibrations of strings, the method comprising the steps of:

scaling an output signal of the sound synthesis model by an amount that indicates the strength of string coupling;

generating a plurality of string sound signals from the scaled output signal using a plurality of single-string emulators; and summing the output signal from the sound synthesis model with said plurality of string sound signals.

2. The method of claim 1 wherein the single-string emulators use waveguide synthesis.

3. The method of claim 1 wherein:

the sound synthesis model emulates a musical instrument having strings; and the step of generating string sound signals includes using of single-string emulators which emulate the sound of the strings of said musical instrument.

4. The method of claim 3 wherein the single-string emulators use waveguide synthesis.

5. The method of claim 1 wherein:

the sound synthesis model emulates a musical instrument with at least twelve strings; and the step of generating string sound signals further comprises generating twelve or more string sound signals using twelve or more string emulators which emulate notes in an octave.

6. The method of claim 5 wherein the single-string emulators use waveguide synthesis.

7. The method of claim 1 wherein:

the sound synthesis model emulates a piano; and the step of generating string sound signals comprises generating string sound signals using string emulators which emulate the sound of the strings of the next to the lowest octave of the piano.

8. A method for improving a sound synthesis model to account for sympathetic vibrations of strings, the method comprising the steps of:

combining an output signal of the sound synthesis model with string sound signals from a plurality of single-string emulators to create a combined signal;

scaling the combined signal by an amount that indicates the strength of string coupling;

generating a plurality of string sound signals from the scaled combined signal using the plurality of single-string emulators; and summing the output signal from the sound synthesis model with said plurality of string sound signals to provide an output sound signal.

9. The method of claim 8, wherein the steps of combining further comprises:

summing all of the string sound signals from the plurality of single-string emulators;

scaling the sum of the string sound signals; and adding the scaled sum and the output signal from the sound synthesis model.

10. The method of claim 9 wherein the single-string emulators use waveguide synthesis.

11. The method of claim 10 wherein:

the sound synthesis model emulates a musical instrument with at least twelve strings; and the step of generating string sound signals includes generating twelve or more string sound signals using twelve or more string emulators which emulates the notes in an octave.

12. A sound synthesizer comprising:

means for scaling a digital signal according to a desired strength for sympathetic string vibrations, the scaling means having an input bus for accepting a digital signal which represents a sound amplitude and an output bus for carrying a scaled digital signal;

a plurality of single-string emulators coupled to the output bus of the scaling means, each single-string emulator processing the scaled digital signal to produce on an output bus an output digital signal which represents a sound made by a sympathetic vibration of a string; and an adder having an input bus coupled to the output buses of the single-string emulators, the adder providing on an output bus a signal representing the sum of the digital signals provided on the input bus.

13. The sound synthesizer of claim 12, wherein:

the plurality of single-string is comprised of twelve single-string emulators; and each single-string emulator produces a signal that represent a sound corresponding to a note on a chromatic scale.

14. The sound synthesizer of claim 12, further comprising:

a piano emulator; and means for coupling the piano emulator to the input bus of the scaling means.

15. The sound synthesizer of claim 14, wherein the means for coupling comprises a switch which selectably passes signals form the piano emulator to the input bus of the scaling means and thereby selectably synthesize a piano sound with or without a damper pedal being pressed.

16. The sound synthesizer of claim 12, further comprising:

means for coupling the output bus of the adder to the input bus of the scaling means.

17. The sound synthesizer of claim 16, wherein the means for coupling comprises:

a second scaling means having an input bus coupled to the output bus of the adder; and a second adder having an output bus coupled to the input bus of the scaling means, a first input bus coupled to the output bus of the second scaling means, and a second input bus for accepting a digital signal which represents a sound amplitude.

* * * * *